US010724802B2

(12) United States Patent
Courtial et al.

(10) Patent No.: US 10,724,802 B2
(45) Date of Patent: Jul. 28, 2020

(54) HEAT TRANSFER PLATE AND PLATE HEAT EXCHANGER

(71) Applicants: Alfa Laval Corporate AB, Lund (SE); Alfa Laval Packinox, Paris (FR)

(72) Inventors: Mathieu Courtial, Chalon sur Saône (FR); Gilbert Graille, Crissey (FR); Franck Alenda, Chatenoy le Royal (FR); Laurent Fralonardo, Chalon sur Saône (FR); Pierre-Xavier Bussonnet, Dracy-lefort (FR)

(73) Assignees: ALFA LAVAL CORPORATE AB, Lund (SE); ALFA LAVAL PACKINOX, Paris (FR)

( * ) Notice: Subject to any disclaimer, the term of this patent is extended or adjusted under 35 U.S.C. 154(b) by 0 days.

(21) Appl. No.: 15/764,053

(22) PCT Filed: Sep. 30, 2016

(86) PCT No.: PCT/EP2016/073449
§ 371 (c)(1),
(2) Date: Mar. 28, 2018

(87) PCT Pub. No.: WO2017/055568
PCT Pub. Date: Apr. 6, 2017

(65) Prior Publication Data

US 2018/0274865 A1 Sep. 27, 2018

(30) Foreign Application Priority Data

Oct. 2, 2015 (EP) ..... 15188276

(51) Int. Cl.
*F28D 9/00* (2006.01)
*F28F 9/02* (2006.01)

(52) U.S. Cl.
CPC ..... *F28D 9/0062* (2013.01); *F28F 9/026* (2013.01); *F28F 9/0221* (2013.01); *F28F 9/0265* (2013.01); *F28D 9/0068* (2013.01)

(58) Field of Classification Search
CPC ... F28D 9/0062; F28D 9/0068; F28F 2280/04
(Continued)

(56) References Cited

U.S. PATENT DOCUMENTS 2,875,986 A * 3/1959 Holm ..... F28D 9/0068 165/145
3,042,382 A * 7/1962 Hryniszak ..... F28D 9/0075 165/167
(Continued)

FOREIGN PATENT DOCUMENTS

CN 1101418 A 4/1995
CN 1431453 A 7/2003
(Continued)

OTHER PUBLICATIONS

International Search Report (PCT/ISA/210) dated Jan. 24, 2017, by the European Patent Office as the International Searching Authority for International Application No. PCT/EP2016/073449.
(Continued)

*Primary Examiner* — Paul Alvare
(74) *Attorney, Agent, or Firm* — Buchanan Ingersoll & Rooney PC

(57) ABSTRACT

A heat transfer plate that has a base plate; a fluid distribution plate that is arranged on a first end section of the base plate, and a fluid collection plate that is arranged on a second end section of the base plate, the fluid distribution plate comprising a base edge that faces a heat transfer section of the base plate, a distal part that is located at a distance from the base edge, a fluid passage edge that comprises an extension in a direction from the base edge, towards the distal part, a
(Continued)

closed edge that comprises an extension in the direction from the base edge, towards the distal part, and fluid distribution channels that extend from the fluid passage edge to the base edge, for leading fluid from the fluid passage edge to the heat transfer section.

22 Claims, 9 Drawing Sheets

(58) Field of Classification Search
USPC ..... 165/76, 166
See application file for complete search history.

(56) References Cited

U.S. PATENT DOCUMENTS

| | | | | |
|---|---|---|---|---|
| 3,759,323 | A * | 9/1973 | Dawson et al. | F02C 7/105 165/166 |
| 3,866,674 | A * | 2/1975 | Tramuta | F28D 9/0031 165/166 |
| 4,373,579 | A | 2/1983 | Jernqvist et al. | |
| 5,584,341 | A * | 12/1996 | Sabin | F28D 9/0062 165/166 |
| 6,289,977 | B1 | 9/2001 | Claudel et al. | |
| 6,394,178 | B1 * | 5/2002 | Yoshida et al. | F28D 9/005 165/166 |
| 6,752,202 | B2 | 6/2004 | Holm et al. | |
| 7,040,387 | B2 * | 5/2006 | Leuthner | F28D 9/005 165/11.2 |
| 7,055,588 | B2 | 6/2006 | Nickolay et al. | |
| 7,343,965 | B2 * | 3/2008 | Memory et al. | F28D 9/005 165/166 |
| 8,020,612 | B2 | 9/2011 | Wegner | |
| 8,028,410 | B2 * | 10/2011 | Thompson | F28D 9/0043 165/167 |
| 2006/0254759 | A1 | 11/2006 | Johnston | |
| 2010/0025026 | A1 | 2/2010 | Dietz et al. | |
| 2010/0139900 | A1 * | 6/2010 | Thompson | F28D 9/0043 165/166 |

FOREIGN PATENT DOCUMENTS

| | | | |
|---|---|---|---|
| CN | 102767983 | A | 11/2012 |
| CN | 202947522 | U | 5/2013 |
| DE | 43 08 509 | A1 | 9/1994 |
| DE | 10 2008 033 302 | A1 | 1/2010 |
| EP | 0 460 872 | A1 | 12/1991 |
| KR | 10-2006-0011856 | A | 2/2006 |
| KR | 10-2015-0073732 | A | 7/2015 |
| WO | 95/01834 | A1 | 1/1995 |

OTHER PUBLICATIONS

Written Opinion (PCT/ISA/237) dated Jan. 24, 2017, by the European Patent Office as the International Searching Authority for International Application No. PCT/EP2016/073449.

Office Action (The First Office Action) dated Mar. 14, 2019, by the State Intellectual Property Office (SIPO) of the People's Republic of China in corresponding Chinese Patent Application No. 201680056860.4 and an English Translation of the Office Action. (10 pages).

An English Translation of the Office Action (Notice of Preliminary Rejection) dated May 31, 2019, by the Korean Intellectual Property Office in corresponding Korean Patent Application No. 10-2018-7011894. (3 pages).

* cited by examiner

HEAT TRANSFER PLATE AND PLATE HEAT EXCHANGER

TECHNICAL FIELD

The invention relates to a heat transfer plate of a type that has a base plate that has a first end section, a second end section and a heat transfer section that is located there between. A fluid distribution plate is arranged on top of the first end section for distributing a fluid over the heat transfer section, and a fluid collection plate is arranged on top of the second end section for collecting the fluid from the heat transfer section. The invention also relates to a heat exchanger that includes this type of heat transfer plate.

BACKGROUND ART

Today many different types of plate heat exchangers exist and are employed in various applications depending on their type. Generally, a heat exchanger has a number of heat transfer plates that are joined to each other to form a plate stack. In the plate stack there are alternating first and second flow paths in between the plates. A first fluid flows in the first flow path and a second fluid flows in the second flow path. As such flow goes on and when there is a temperature difference between the fluids, heat is transferred from the warmer fluid to the colder fluid.

The design of the heat transfer plates is important for providing efficient transfer of heat between the fluids. The plates must also be durable and should withstand various stresses that may occur, for example due to pressure variations and temperature differences.

The heat transfer plate has typically a dedicated heat transfer area with a pattern that is pressed into the plate. Often the plate has also a fluid distribution area with a dedicated pattern that distributes fluid from an inlet port, or edge, towards the heat transfer area. A corresponding fluid collection area collects fluid that has passed over heat transfer area and leads it towards an outlet port, or edge. The pattern for the fluid distribution and fluid collection areas is often pressed into the plate simultaneously with pressing of the pattern for the heat transfer area.

However, it is not always desired to have the fluid distributing and/or fluid collection pattern on the same plate as the heat transfer pattern. Special types of heat exchangers are then employed, such as the type where individual fluid distribution plates and individual fluid collection plates are located in between base plates that are joined to each other. Between each pair of base plates a fluid distribution plate is then located at one end, and a fluid collection plate is located at another end. Between the ends the base plates have heat transfer areas. This type of arrangement provides e.g. the possibility to accomplish cost efficient manufacturing of large heat exchangers, while still ensuring efficient distribution of fluid to the heat transfer area and subsequent collection of the fluid after it has passed the heat transfer area.

A number of embodiments of heat exchangers with individual fluid distribution and fluid collection plates have been disclosed. In comparison to several other types of plate heat exchangers, the heat exchanger allows the use of large heat transfer plates and provides efficient transfer of heat while still being durable. However, it is estimated that heat exchangers with individual fluid distribution and fluid collection plates may be improved in respect of their capability efficiently distributing fluid to their central heat transfer sections.

SUMMARY

It is an object of the invention to provide an improved heat transfer plate that may be used in plate heat exchangers with individual fluid distribution and fluid collection plates. In particular, it is an object to provide for improved flow distribution for this type of a plate heat exchanger.

To solve these objects a heat transfer plate is provided. The heat transfer plate comprises: a base plate that has a first end section, a second end section and a heat transfer section that is located between the end sections; a fluid distribution plate that is arranged on the first end section of the base plate, for distributing a fluid over the heat transfer section; and a fluid collection plate that is arranged on the second end section of the base plate, for collecting the fluid from the heat transfer section. The fluid distribution plate comprises; a base edge that faces the heat transfer section of the base plate; a distal part that is located at a distance from the base edge; a fluid passage edge that comprises an extension in a direction from the base edge, towards the distal part; a closed edge that comprises an extension in the direction from the base edge, towards the distal part; and fluid distribution channels that extend from the fluid passage edge to the base edge, for leading the fluid from the fluid passage edge to the heat transfer section. The fluid passage edge comprises a first section that is further away from the base edge of the fluid distribution plate than a second section of the fluid passage edge. Fluid distribution channels at the second section have a higher flow resistance in relation to the length of the fluid distribution channel than fluid distribution channels at the first section.

The extension that has been given the inlet edge is advantageous in that it provides for improved flow distribution for a heat exchanger with individual fluid distribution plates. According to another aspect of the invention a plate heat exchanger that uses the heat transfer plate is provided. Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
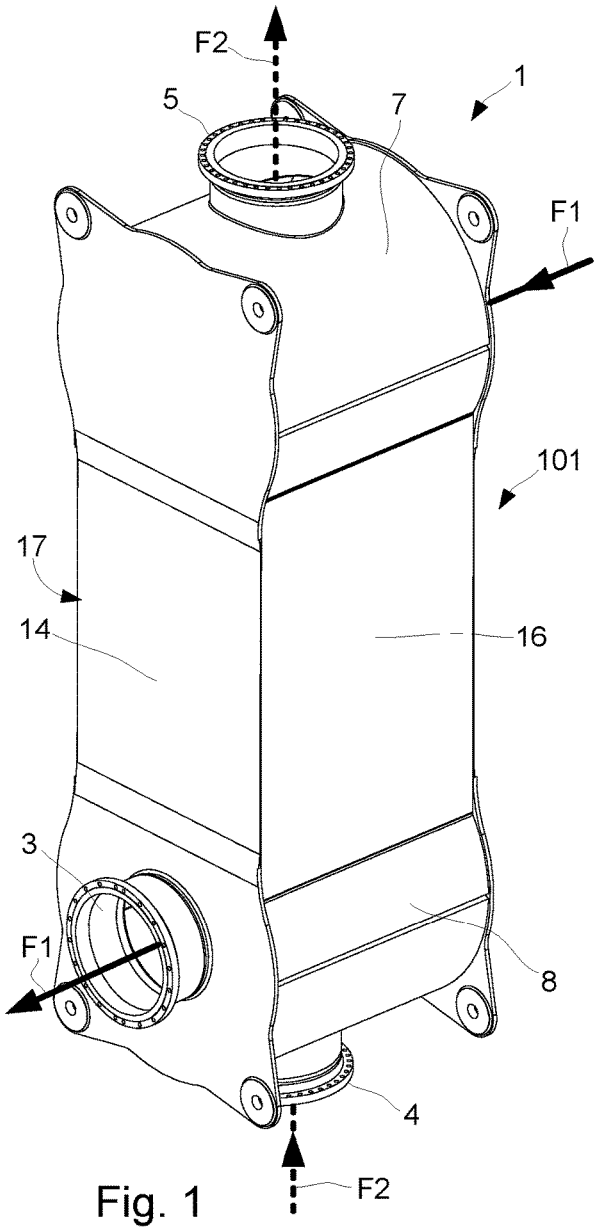
FIG. 1 is a perspective view of a plate heat exchanger with individual fluid distribution and fluid collection plates.
Figure 2:
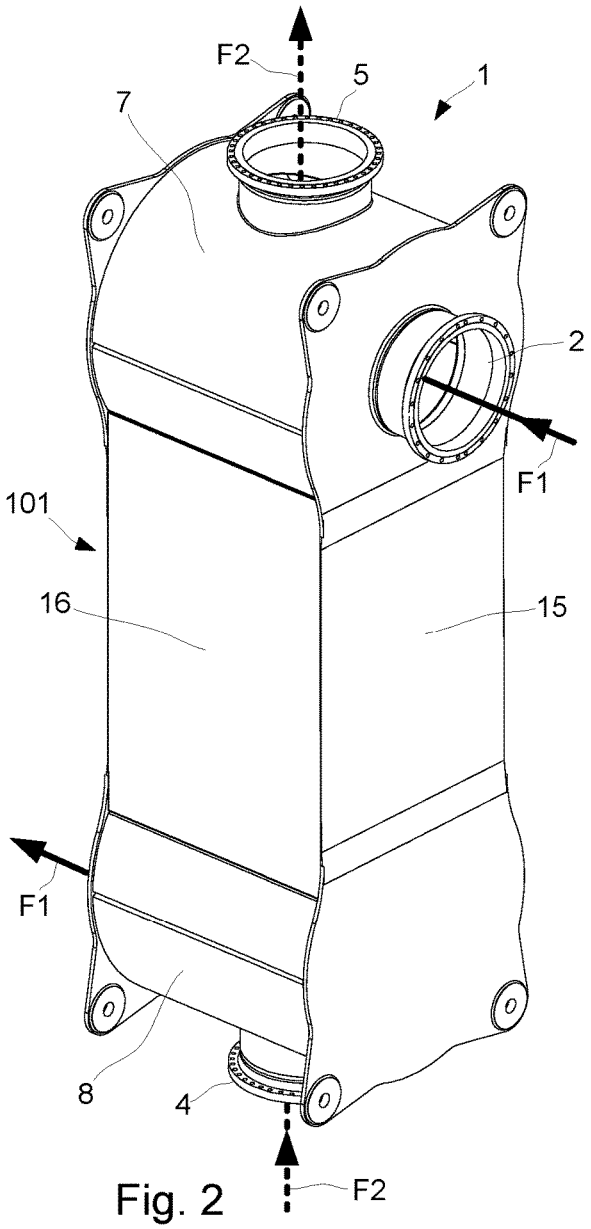
FIG. 2 is another perspective view of the plate heat exchanger of FIG. 1.
Figure 3:
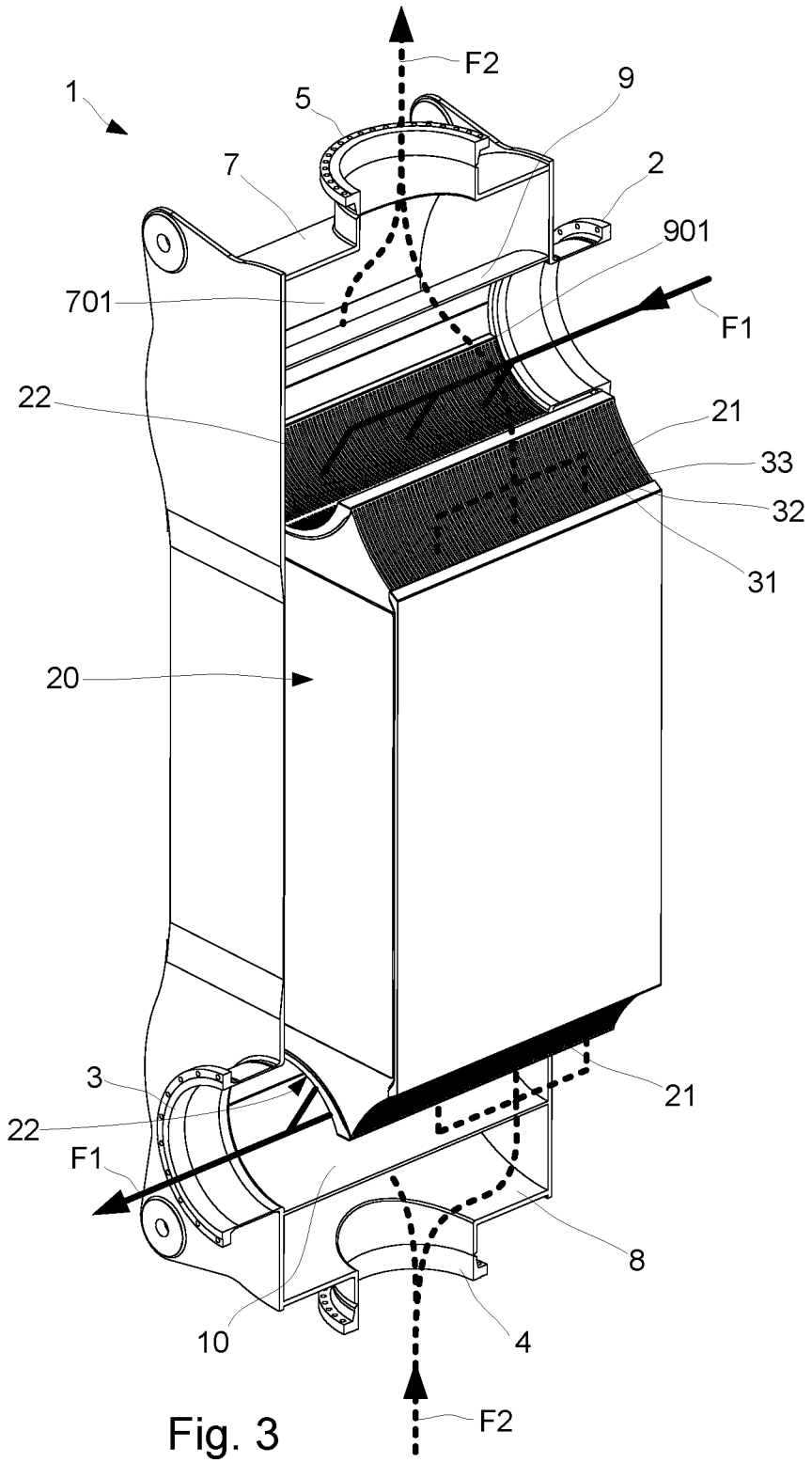
FIG. 3 is a view of the plate heat exchanger of FIG. 1, showing part of the inside of the plate heat exchanger.

With reference to FIGS. 1-3 a plate heat exchanger 1 of the type with individual fluid distribution and fluid collection plates is illustrated. The plate heat exchanger 1 has a casing 101 that is made from four side panels 117 and two header boxes 7, 8. The side panels 117 are joined to each other so as to form a cuboidal box with two opposite, open sides. The first header box 7 is attached to the side panels 117 at the first open side and the second header box 8 is attached to the side panels 117 at the second open side. The side panels 117 and header boxes 7, 8 together form a sealed enclosure in which a plate stack 20 is arranged.

The first header box 7 has an inlet 2 for a first fluid F1 and an outlet 5 for second fluid F2. The second header box 8 has an outlet 3 the first fluid F1 and an inlet 4 for second fluid F2. The plate stack 20 is made of a number of heat transfer plates 31-33 that are joined to each other such that alternating first and second flow paths 21, 22 for the first fluid F1 and the second fluid F2 are formed in between the heat transfer plates 31-33. The heat transfer plates 31-33 are spaced apart so that flow channels are formed between the heat transfer plates, and every second flow channel between the heat transfer plates is part of the first fluid path 21, while every other, second flow channel between the heat transfer plates is part of the second fluid path 22.

Every component of the plate heat exchanger 1 may be made of metal, such as steel, and the heat transfer plates are typically made of steel sheets, as conventional within the industry. The parts of the plate heat exchanger 1 are typically joined by conventional welding techniques. Other material and techniques for joining the parts may be used as well.

Figure 4:
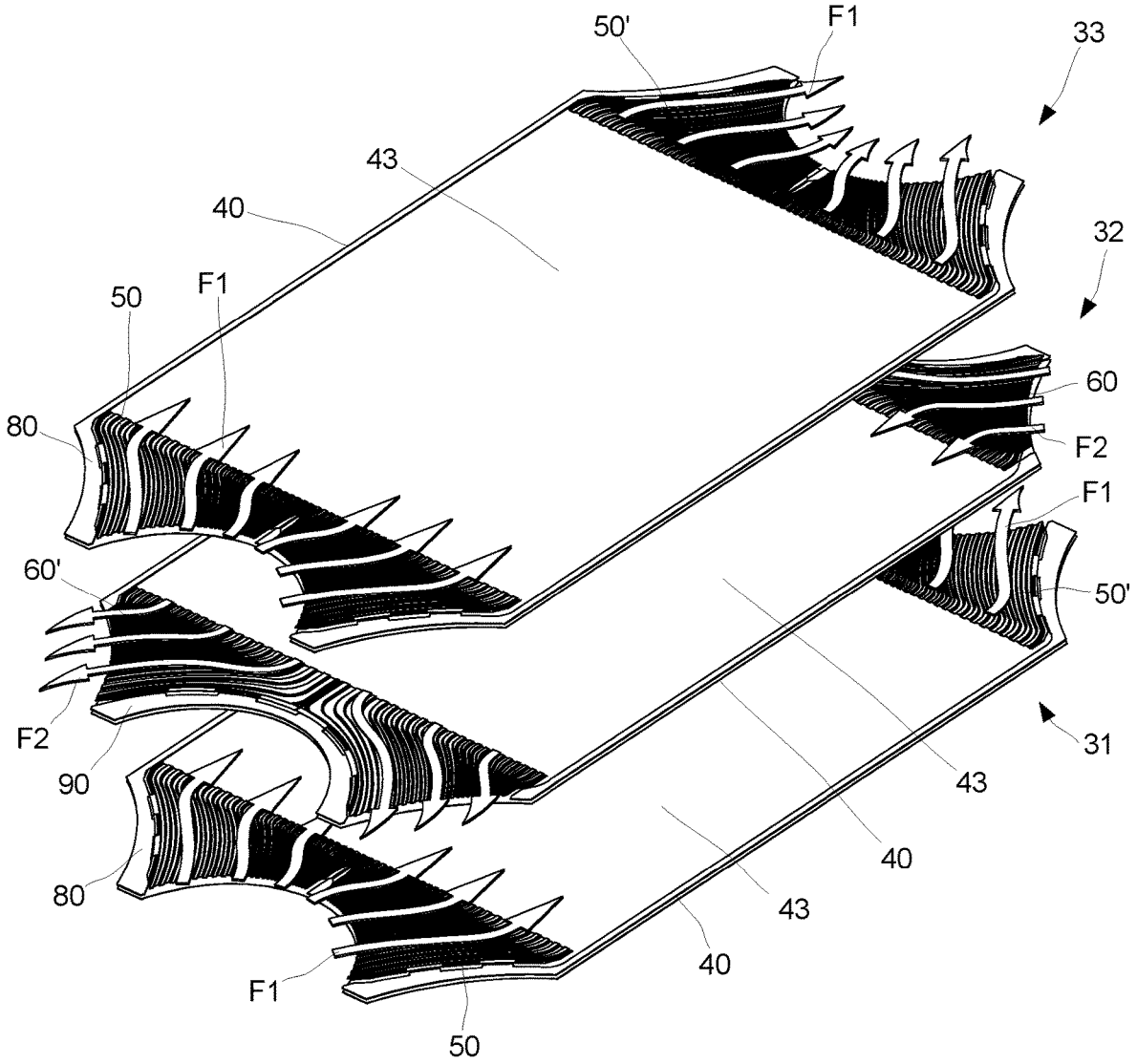
FIG. 4 is a perspective view of three heat transfer plates that is used in the plate heat exchanger of FIG. 1, FIGS. 5-8 are top views of a base plate, a spacer, a fluid distribution plate and a fluid collection plate that are part of the uppermost and lowermost heat transfer plates of FIG. 4, FIGS. 9-12 are top views of a base plate, a spacer, a fluid distribution plate and a fluid collection plate that are part of the heat transfer plate that is located in the middle of FIG. 4, between the uppermost and lowermost heat transfer plates.
Figure 5:
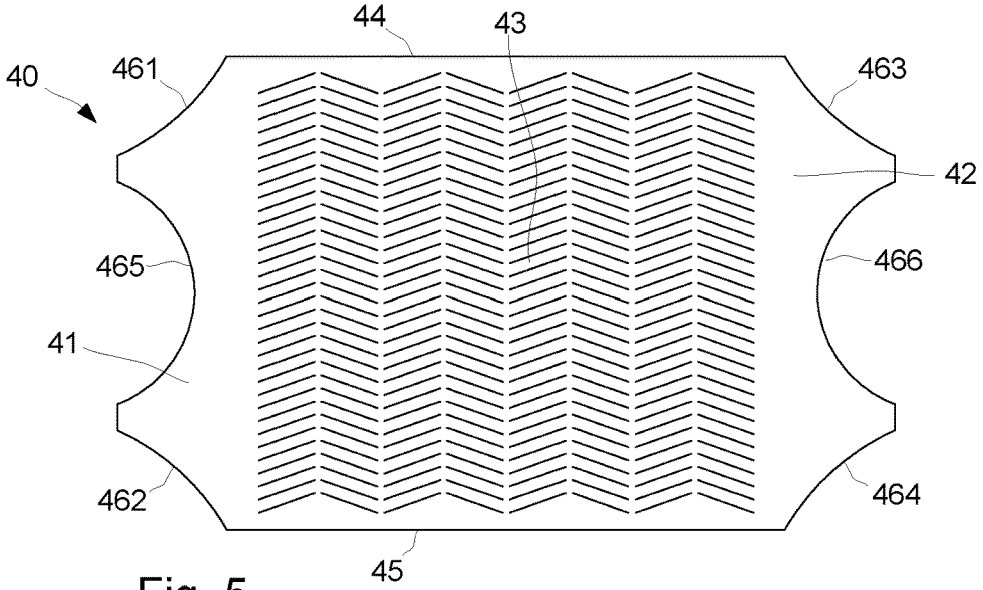
Figure 6:
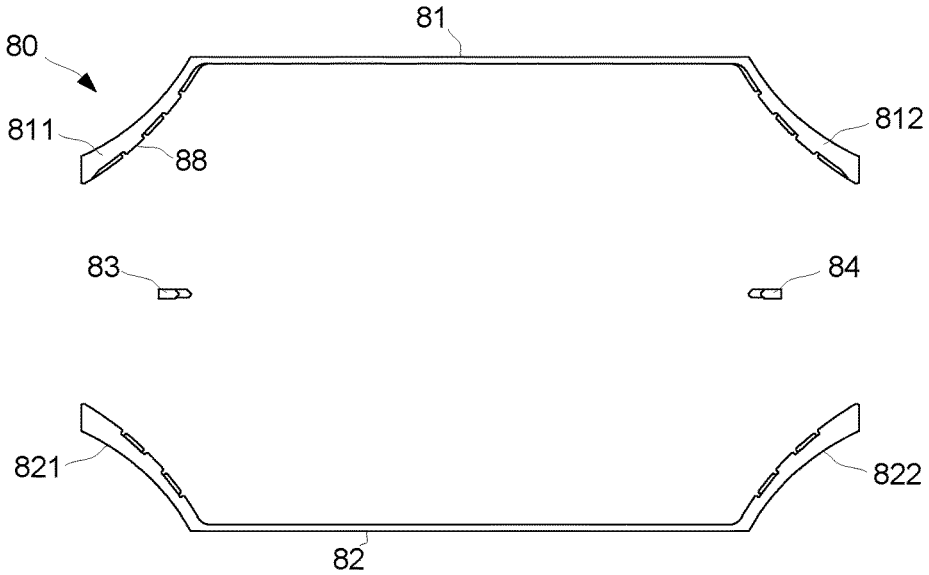
Figure 7:
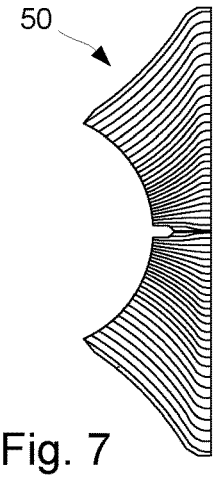

With reference to FIG. 4, three heat transfer plates 31-33 that are part of the plate stack 20 are illustrated. Two different types of heat transfer plates are used and are alternatively attached to each other to form the plate stack 20. The first type of heat transfer plate is in the figure represented by a first heat transfer plate 31 and by a third heat transfer plate 33, while the second type of heat transfer plate is represented by a second heat transfer plate 32 that is located between the first heat transfer plate 31 and the third heat transfer plate 33. The plate stack 20 may have any suitable number of heat transfer plates of the shown types, such as 10 to 200 or more heat transfer plates. The two different types of heat transfer plates are alternatively stacked on top of each other.

The first fluid F1 flows in interspaces between every second pair of heat transfer plates in the plate stack 20, such as between the first heat transfer plate 31 and the second heat transfer plate 32. The second fluid F2 flows in interspaces between every other, second pair of heat transfer plate in the plate stack 20, such as between the second heat transfer plate 32 and the third heat transfer plate 33. The direction of the flow of the second fluid F2 is opposite that of the first fluid F1, as may be seen in the figure.

Figure 8:
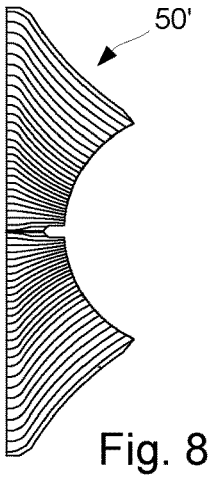
Figure 9:
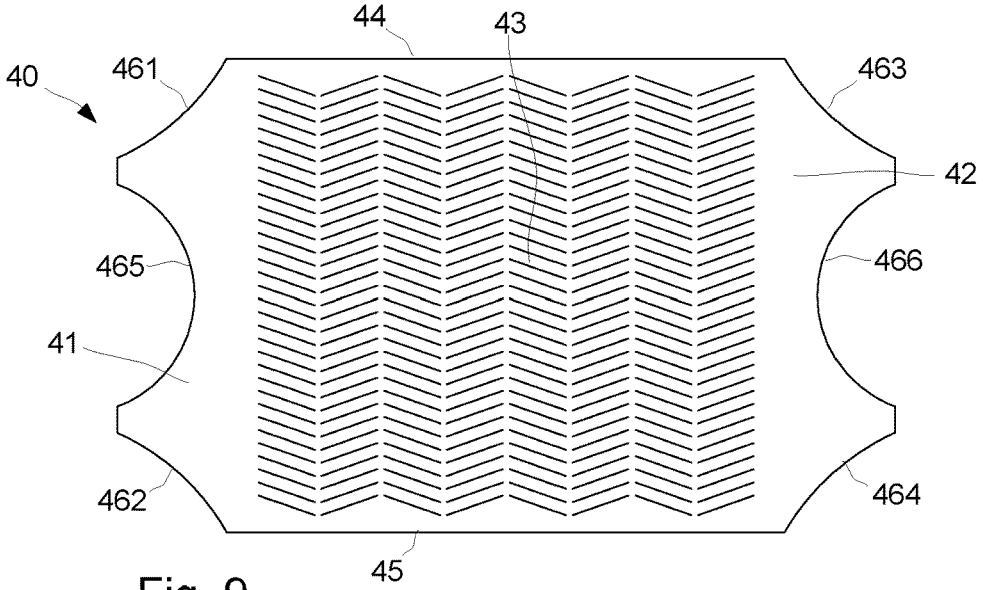
Figure 10:
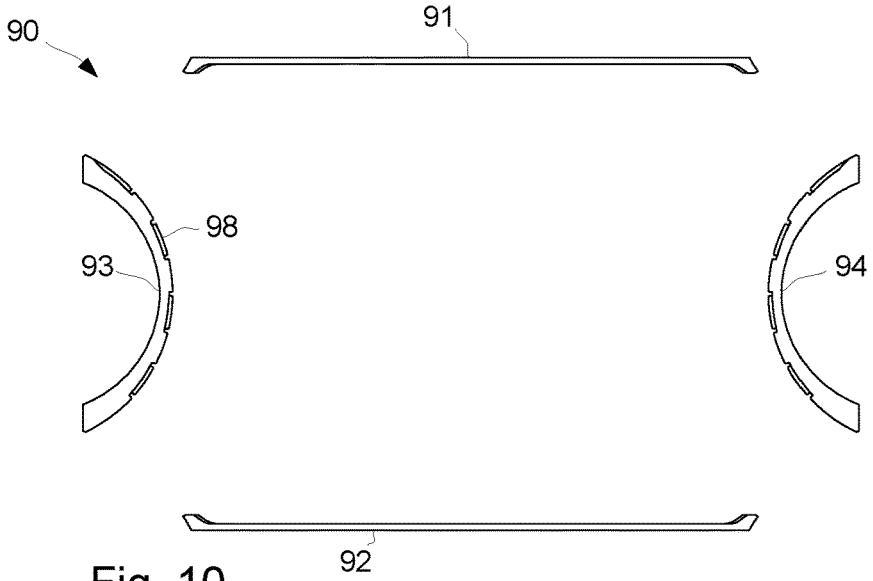
Figure 11:
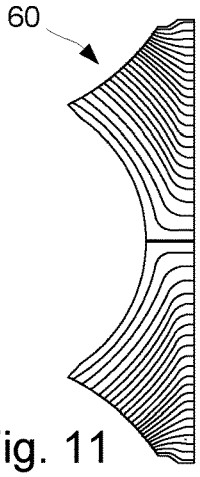
Figure 12:
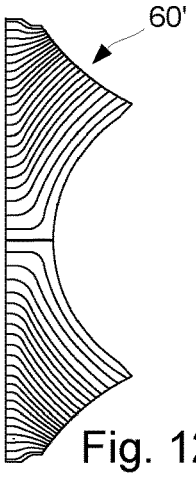

With further reference to FIGS. 5-8 the first type of heat transfer plates, here represented by the first heat transfer plate 31, comprises a base plate 40 (FIG. 5), a fluid distribution plate 50 (FIG. 7) and a fluid collection plate 50' (FIG. 8). In the illustrated embodiment the fluid collection plate 50' has the same principal shape and features as the fluid distribution plate 50, and may typically be identical to the fluid distribution plate 50.

The base plate 40 has a first end section 41, a second end section 42 and a heat transfer section 43 that is located between the end sections 41, 42. The heat transfer section 43 is provided with any suitable, conventional type of corrugation pattern that provides a desired transfer of heat between the flow paths 21, 22. The first end section 41 and the second end section 43 are flat. The base plate 40 has first and second elongated sides 44, 45 that extend between the end sections 41, 42, and the heat transfer section 43 is located between the elongated sides 44, 45.

As may be seen, the base plate 40 has the shape of a rectangle with four concave corner cut-outs 461-464 at the corners of the rectangle, and with a first concave, center cut-out 465 at the center of the first short side of the rectangle, and a second concave, center cut-out 466 at the center of a second short side of the rectangle. The first and second corner cut-outs 461, 462 are located at the first short side of the rectangle, and the first concave cut-out 465 is located at the center of the first short side, between the first and second corner cut-outs 461, 462. The third and fourth corner cut-outs 463, 464 are located at the second short side of the rectangle, and the second concave cut-out 465 is locate at the center of the second short side, between the third and fourth corner cut-outs 463, 464.

From the illustration it is clear the first center cut-out 465 is located between the first and second corner cut outs 461, 462. Correspondingly, the second center cut-out 466 is located between the third and fourth corner cut outs 463, 464.

The first and second corner cut-outs 461, 462 and the first concave cut-out 465 at the center of the first short are located on the first end section 41. The third and fourth corner cut-outs 463, 464 and the second concave cut-out 466 at the center of the second short are located on the second end section 42. The shape of each cut out 461-466 is typically continuously curved, so that the cut-outs 461-466 are arc-shaped.

Spacers are located between the heat transfer plates, such a first type of spacer 80 that is arranged on the base plate 40 of the first type of heat transfer plate (the first heat transfer plate 31). The spacer 80 has four spacer parts 81-84. The first spacer part 81 extends along the first elongated side 44 of the base plate 40 and has first and second spacer extensions 811, 812. The first spacer extension 811 extends along the first corner cut-out 461 and the second spacer extension 812 extends along the third corner cut-out 463.

The second spacer part 82 extends along the second elongated side 45 of the base plate 40 and has first and second spacer extensions 821, 822, where the first spacer extension 821 extends along the second corner cut-out 462 and where the second spacer extension 822 extends along the fourth corner cut-out 464.

The third spacer part 83 is a small part that is located in the middle of the first center cut-out 465, i.e. at equal distances from the elongated sides 44, 45. The fourth spacer part 84 is a similar, small part, but located in the middle of the second center cut-out 466, i.e. also at equal distances from the elongated sides 44, 45.

The fluid distribution plate 50 is placed on top of the first end section 41 of the base plate 40, and the fluid collection plate 50' is placed on top of the second end section 42 of the base plate 40 (see FIG. 4). The first and second spacer parts 81, 82 have tabs 88 that engage the fluid distribution and fluid collection plates 50, 50'. All parts of the spacer 80 are typically tack welded to the base plate 40 and the fluid distribution and fluid collection plates 50, 50' are tack welded to the spacer 80.

With further reference to FIGS. 9-12 the second type of heat transfer plates, here represented by the second heat transfer plate 32, comprises a base plate 40, a fluid distribution plate 60 and a fluid collection plate 60'. In the illustrated embodiment the fluid collection plate 60' has the same principal shape as the fluid distribution plate 60, and may typically be identical to the fluid distribution plate 60.

The base plate 40 for the second heat transfer plate 32 is similar to the base plate that is used for the first heat transfer plate 31, i.e. both types of heat transfer plates 31, 32 have the same type of base plate. Since the base plate 40 is symmetrical, the base plate 40 for the second heat transfer plate 32 may be flipped 180° about an axis that is parallel to the elongated side 44, 45. The only difference then lies in that a pattern of the heat transfer area 43 is mirrored for the second heat transfer plate 32, as compared with the pattern for the heat transfer area of the first heat transfer plate 31. In all other aspects the base plates 40 for both the first heat transfer plate 31 and the second heat transfer plate 32 are identical, and are therefore given the same reference numeral in the figures. Alternatively, the pattern of the heat transfer area 43 for the second heat transfer plate 32 may be stamped differently in to the base plate 40, or it may be the same as for the first heat transfer plate 31.

A second, different type of spacer 90 is placed on the base plate 40 for the second heat transfer plate 32. This spacer 90 has four spacer parts 91-94, where a first spacer part 91 extends along the first elongated side 44 of the base plate 40 and a second spacer part 92 extends along the second elongated side 45 of the base plate 40. A third spacer part 93 extends along the first center cut-out 465 and a fourth spacer part 94 extends along the second center cut-out 466.

The fluid distribution plate 60 for the second heat transfer plate 32 is placed on top of the first end section 41 of the base plate 40, and the fluid collection plate 60' for the second heat transfer plate 32 is placed on top of the second end section 42 of the base plate 40 (see FIG. 4).

The third and fourth spacer parts 93, 94 have tabs 98 that engage the fluid distribution and fluid collection plates 60, 60' for the second heat transfer plate 32. All parts of the spacer 90 are typically tack welded to the base plate 40 and the fluid distribution and fluid collection plates 60, 60' are tack welded to the spacer 90. The fluid distribution and fluid collection plates 60, 60' for the second heat transfer plate 31 are different from the fluid distribution and fluid collection plates 50, 50' of the first heat transfer plate 31.

All spacer parts 81-84 and 91-94 have a respective width that extends inwardly towards a center of the base plate on which they are arranged.

The second heat transfer plate 32 is placed on top of the first heat transfer plate 31. A space, i.e. a fluid channel, is then formed between the plates 31, 32 by virtue of the first type of spacer 80. The fluid channel between the plates 31, 32 is then part of the first fluid path 21 for the first fluid F1. The spacing between the plates 31, 32 corresponds to the height of the spacer 80. The third heat transfer plate 33, which is similar to the first heat transfer plate 31, is placed on top of the second heat transfer plate 32. A space, i.e. a fluid channel, is then formed between the second heat transfer plate 32 and the third heat transfer plate 33 by virtue of the second type of spacer 90. The fluid channel between the second and third heat transfer plates 32, 33 is then part of the second fluid path 22 for the second fluid F2. The spacing between the plates 32, 33 corresponds to the height of the spacer 90.

The two different types of heat transfer plates are continuously and alternatively stacked on each other in this way for creating fluid channels between the plates, for the first and second fluid F1, F2. When a desired number of heat transfer plates have been stacked, then the plates are joined to each other by welding along the spacers 80, 90, at locations where the spacers abut the outer peripheral edges of the base plates 40. Thus, each spacer is welded to each of the two base plates that the spacer is located between. In this way the plate stack 20 is formed. The outermost plates in the stack may be plain, flat plates, since they will have a fluid channel on only one of its sides, and will thus not transfer any heat between the fluids F1, F2. The fluid distribution and fluid collection plates 50, 50', 60, 60' are corrugated and fluid passes on both sides of each plate.

For the plates described herein, the base plate 40 may be referred to as a first plate, the fluid distribution plate 50 or 60 may be referred to as a second plate, and the fluid collection plate 50' or 60' may be referred to as a third plate. These three types of plates are individual plates that are assembled together to form a heat transfer plate.

As mentioned, the fluid collection plate 50' is similar to the fluid distribution plate 50. Thus, the shape of the fluid distribution plate 50 determines how efficient fluid is distributed to, respectively collected from, the heat transfer section 43 of the base plate 40. The cut-outs 461-466 in the base plate 40 have therefore given shapes that correspond to the shape of the fluid distribution plate 50, with account for the spacers 80, 90.

Figure 13:
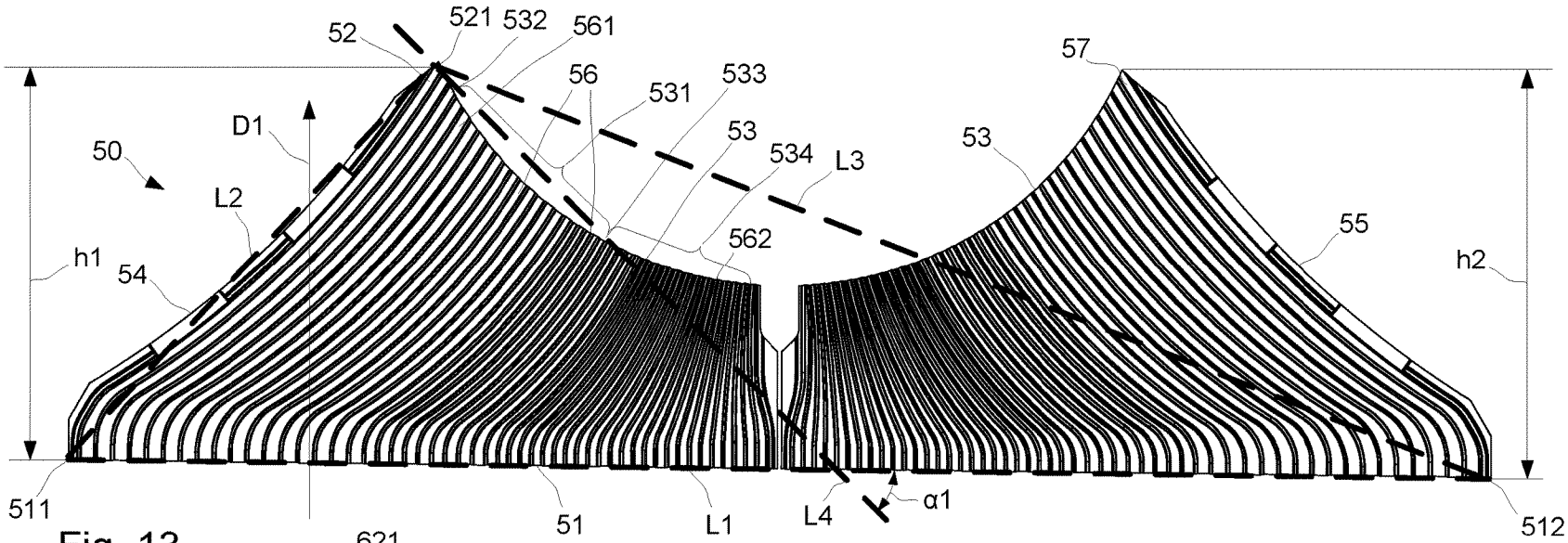
FIG. 13 is a top view of a plate that corresponds to the fluid distribution plate and the fluid collection plate that are part of the uppermost and lowermost heat transfer plates of FIG. 4.

With reference to FIG. 13, the shape of the fluid distribution plate 50 for the first heat transfer plate 31 can be seen in detail. The fluid distribution plate 50 has a base edge 51 that faces the heat transfer section 43 of the base plate 40. A distal part 52 is located at a distance h1 from the base edge 51. Here, "distal part" means a part of the fluid distribution plate 50 that is located at a distance from the base edge 51 (hence distal). The distal part 52 may also be referred to as a tip 52, which may have a pointed or blunt tip shape. From the tip 52 a fluid passage edge 53 extends in a direction towards the base edge 51. In other words, the fluid passage edge 53 has an extension in a direction D1 from the base edge 51, towards the tip 52. As may be seen from the figure, the fluid passage edge 53 has also an extension in a direction that is parallel to the base edge 51. The direction D1 may be referred to as first direction D1.

The fluid distribution plate 50 has a closed edge 54 that comprises an extension in the same direction D1 from the base edge 51, towards the distal part 52, i.e. the tip 52. The closed edge 54 has also an extension in a direction that is parallel to the base edge 51. Fluid distribution channels 56 extend from the fluid passage edge 53 to the base edge 51, for leading the first fluid F1 from the fluid passage edge 53 to the heat transfer section 43.

In another embodiment of the fluid distribution plate 50, using a different terminology, it may be said the fluid distribution plate 50 comprises: a base edge 51 that faces the heat transfer section 43 of the base plate 40; a tip 52 that is located at a distance h1 from the base edge 51; a fluid passage edge 53 that extends from the tip 52 and in a direction towards the base edge 51; a closed edge 54 that extends from the tip 52, in the direction towards the base edge 51 and from a side of the tip 52 that is opposite a side of the tip 52 from which the fluid passage edge 53 extends; and fluid distribution channels 56 that extend from the fluid passage edge 53 to the base edge 51, for leading fluid F1 from the fluid passage edge 53 to the heat transfer section 43.

The base edge 51 extends from a first base end 511 to a second base end 512 of the fluid distribution plate 50, and the tip 52 is located between the two base ends 511, 512, as seen along a direction D1 that is perpendicular to a line L1 that extends from the first base end 511 to the second base end 512.

The line L1 that extends from the first base end 511 to the second base end 521 forms a first line L1. A second line L2 extends from the first base end 511 to a point 521 on the tip 52. A third line L3 extends from the second base end 512 to the point 521 on the tip 52. By virtue of the location of the tip 52, the first, second and third lines L1, L2, L3 form an acute triangle. The fluid passage edge 53 comprises a concave shape. The closed edge 54 also comprises a concave shape. The lines L1, L2, L3 are all straight lines.

The fluid passage edge 53 comprises at least one edge section 531 that extends from a first point 532 on the fluid passage edge 53, to a second point 533 on the fluid passage edge 53, where the second point 533 is located closer to the base edge 51 than the first point 521. Using this terminology, another embodiment of the fluid distribution plate 50 comprises: the base edge 51 that faces the heat transfer section 43 of the base plate 40; a fluid passage edge 53 that has an edge section 531 that extends from a first point 532 on the fluid passage edge 53 to a second point 533 on the fluid passage edge 53, the first point 532 being located further away from the base edge 51 than the second point 533; a closed edge 54; and the fluid distribution channels 56 that extend from the fluid passage edge 53 to the base edge 51, for leading the fluid F1 from the fluid passage edge 53 to the heat transfer section 43.

A straight line L4 that extends through the first point 532 and through the second point 533 is inclined to the first line L1 by an angle $\alpha 1$ of between 15 to 75 degrees. The different embodiments, or variants for describing the fluid distribution plate 50, may be combined.

As may be seen from the figures, the distal part 52 is a first distal part 52, or first distal tip 52, while the closed edge 54 is a first closed edge 54. The distribution plate 50 comprises a second distal part 57, or tip 57, that is located at a distance h2 from the base edge 51. A second closed edge 55 has an extension in a direction D1 from the base edge 51, towards the second tip 57. The fluid passage edge 53 extends from the first tip 52 to the second tip 57.

Thus, the fluid distribution plate 50 comprises: the base edge 51; a second tip 57 that is located at a distance h2 from the base edge 51, the fluid passage edge 53 extending also from the second tip 57 and in a direction towards the base edge 51; a second closed edge 55 that extends from the second tip 52, in the direction towards the base edge 51 and from a side of the second tip 52 that is opposite a side of the second tip 57 from which the fluid passage edge 53 extends.

The second closed edge 55 comprises a concave shape. Basically, the fluid passage edge 53 comprises the form of an arc that extends into the fluid distribution plate 50. Each of the first closed edge 54 and the second closed edge 55 also comprise the form of an arc.

As mentioned, the fluid passage edge 53 comprises a first section 531. This section is located further away from the base edge 51 than a second, different section 534 of the fluid passage edge 53. Fluid distribution channels 562 at the second section 534 have a higher flow resistance in relation to the length of the fluid distribution channel than fluid distribution channels 561 at the first section 531. An alternative formulation of this is that fluid distribution channels 562 extending from the second section 534 have a higher flow resistance in relation to the length of the fluid distribution channel than fluid distribution channels 561 extending from the first section 531. Another alternative formulation of this is that fluid distribution channels 562 that extend from the fluid passage edge 53 at the second section 534 to the base edge 51 have a higher flow resistance in relation to the length of the fluid distribution channel than fluid distribution channels 561 that extend from the fluid passage edge 53 at the first section 531 to the base edge 51. By having a higher flow resistance in relation to the length of the fluid distribution channel in the fluid distribution channels 562 at the second section 534 than in the fluid distribution channels 561 at the first section 531, the fluid entering the heat transfer section 43 of the base plate 40 will have more uniform characteristics which implies that the fluid entering the heat transfer section will be more homogenous e.g. in terms of speed and pressure and the fluid will be more evenly distributed over the heat transfer section 43 of the base plate 40. Thereby, a more efficient heat transfer is obtained. By having a higher flow resistance in relation to the length of the fluid distribution channel for the fluid distribution channels 562 at the second section 534 than for fluid distribution channels 561 at the first section 531, it is compensated for the longer fluid distribution channels at the first section.

Fluid distribution channels 562 at the second section 534 may have a higher flow resistance per unit length of the fluid distribution channel than fluid distribution channels 561 at the first section 531.

Fluid distribution channels 561 at the first section 531 may have substantially the same flow resistance, e.g. substantially the same friction, as fluid distribution channels 562 at the second section 534. More precisely, fluid distribution channels 561 at the first section 531 may have substantially the same total flow resistance as fluid distribution channels 562 at the second section 534. That is, fluid distribution channels 561 at the first section 531 may have substantially the same flow resistance over the whole fluid distribution channel, i.e. the same total flow resistance from the fluid passage edge 53 to the base edge 51, as fluid distribution channels 562 at the second section 534. Thereby, the fluid from the fluid distribution channels 561 at the first section 531 and from the fluid distribution channels 562 at the second section 534 entering the heat transfer section 43 of the base plate 40 will have uniform characteristics e.g. in terms of speed and pressure and the fluid will be evenly distributed over the heat transfer section 43 of the base plate 40. This can also be expressed as that fluid distribution channels 561 at the first section 531 may have substantially the same pressure drop, i.e. the same total pressure drop, as fluid distribution channels 562 at the second section 534. The pressure drop is the difference in pressure between the inlet and outlet to the distribution channel, i.e. the difference between the pressure at the fluid passage edge 53 and the pressure at the base edge 51.

A higher flow resistance may be obtained by a smaller mean cross-sectional area of the fluid distribution channels and/or by restraints in the fluid distribution channels.

Fluid distribution channels 562 at the second section 534 have a smaller mean cross-sectional area than fluid distribution channels 561 at the first section 531. A mean cross-sectional area is an average cross-sectional area along the fluid distribution channel extending from the fluid passage edge 53 to the base edge 51. A smaller mean cross-sectional area gives a higher flow resistance and a higher pressure drop.

A smaller mean cross-sectional area may be obtained by fluid distribution channels 562 at the second section 534 being narrower than fluid distribution channels 561 at the first section 531, fluid distribution channels 561 at the first section 531 being divided into subchannels and/or divided into more subchannels than fluid distribution channels 562 at the second section 534 and/or fluid distribution channels 561 at the first section 531 being divided into subchannels being wider than subchannels into which fluid distribution channels 562 at the second section 534 are divided. Thus, both fluid distribution channels 561 at the first section 531 and fluid distribution channels 562 at the second section 534 may be divided into subchannels, but the subchannels of fluid distribution channels 561 at the first section 531 are more and/or wider than subchannels of fluid distribution channels 562 at the second section 534.

Fluid distribution channels 562 at the second section 534 being narrower than fluid distribution channels 561 at the first section 531 implies that fluid distribution channels 561 at the first section 531 are wider than fluid distribution channels 562 at the second section 534.

Fluid distribution channels 562 at the second section 534 may comprise a restraint, e.g. fluid distribution channels 562 at the second section 534 may comprise a winding or an obstacle. A restraint gives a higher flow resistance and a higher pressure drop.

The winding may for example be a meander, such as a zig-zag path, such that the fluid distribution channels 562 at the second section 534 comprises at least a portion that describes a winding, such as a meander. The fluid distribution channels 562 at the second section 534 may be in the shape of a meander.

The obstacle may be an object, such as a knob or a pillar, arranged in the fluid distribution channel or a protuberance in the plate projecting into the fluid distribution channel.

Fluid distribution channels 562 extending from a position on the fluid passage edge 53 relatively further away from the distal part 52 in the direction D1 have a gradually higher flow resistance in relation to the length of the fluid distribution channel than fluid distribution channels 561 extending from a position on the fluid passage edge 53 relatively closer to the distal part 52 in the direction D1. The gradually higher flow resistance in relation to the length of the fluid distribution channel may be continuously higher for each fluid distribution channel or stepwise higher. Stepwise higher flow resistance may be arranged such that a group of adjacent fluid distribution channels have the same flow resistance in relation to the length of the fluid distribution channel. The stepwise higher flow resistance may be obtained such that a first group of fluid distribution channels, preferably comprising a small number of fluid distribution channels, relatively closer to the distal part basically have the same flow resistance in relation to the length of the fluid distribution channel and a second group of fluid distribution channels, preferably also comprising a small number of fluid distribution channels which number may be the same or different as the number of fluid distribution channels in the first group of fluid distribution channels, relatively further away from the distal part basically have the same flow resistance in relation to the length of the fluid distribution channel and the second group of fluid distribution channels have a higher flow resistance in relation to the length of the fluid distribution channel than the first group of fluid distribution channels, Fluid distribution channels 561 at the first section 531 are wider than fluid distribution channels 562 at the second section 534. In principle, fluid distribution channels extend from the fluid passage edge 53 to the base line 51. Those channels that extend further away towards the base line 51, i.e. those that are relatively longer, are wider than those channels that have a shorter extension.

Figure 14:
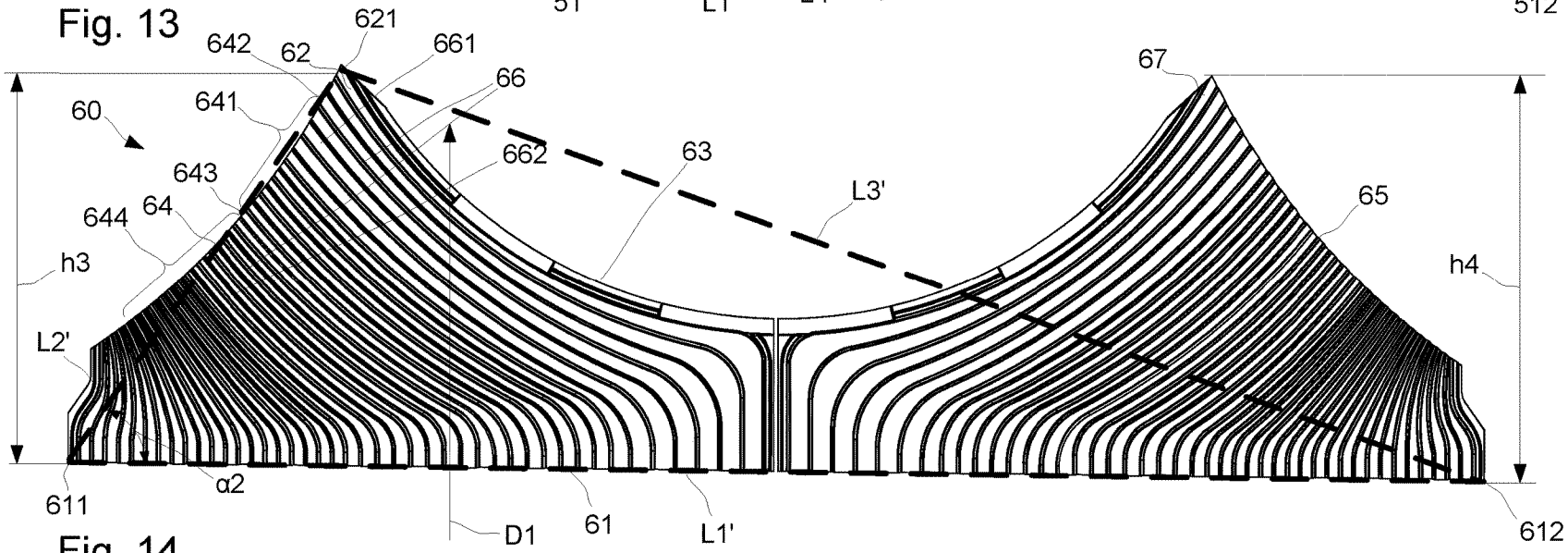
FIG. 14 is a top view of a plate that corresponds to a fluid distribution plate and a fluid collection plate that are part of the heat transfer plate that is located in the middle of FIG. 4, between the uppermost and lowermost heat transfer plates.

With reference to FIG. 14, the shape of the fluid distribution plate 60 for the second heat transfer plate 32 can be seen in detail. The fluid distribution plate 60 has a base edge 61 that faces the heat transfer section 43 of the base plate 40 of the second heat transfer plate 32. A distal part 62 is located at a distance h3 from the base edge 61. "Distal part" means a part of the fluid distribution plate 60 that is located at a distance from the base edge 61. The distal part 62 may also be referred to as a tip 62, which may have a pointed or blunt tip shape. From the distal tip 62 a fluid passage edge 64 extends in a direction towards the base edge 61. In other words, the fluid passage edge 64 has an extension in a direction D1 from the base edge 61, towards the tip 62. As may be seen from the figure, the fluid passage edge 64 has also an extension in a direction that is parallel to the base edge 61.

The fluid distribution plate 60 has a closed edge 63 that comprises an extension in the same direction D1 from the base edge 61, towards the tip 62. The closed edge 64 has also an extension in a direction that is parallel to the base edge 61. Fluid distribution channels 66 extend from the fluid passage edge 64 to the base edge 61, for leading the second fluid F2 from the fluid passage edge 64 to the heat transfer section 43 of the base plate 40.

In another embodiment of the fluid distribution plate 60, using a different terminology, it may be said the fluid distribution plate 60 comprises: a base edge 61 that faces the heat transfer section 43 of the base plate 40; a tip 62 that is located at a distance h3 from the base edge 61; a fluid passage edge 64 that extends from the tip 62 and in a direction towards the base edge 61; a closed edge 64 that extends from the tip 62, in the direction towards the base edge 61 and from a side of the tip 62 that is opposite a side of the tip 62 from which the fluid passage edge 64 extends; and fluid distribution channels 66 that extend from the fluid passage edge 64 to the base edge 61, for leading fluid F2 from the fluid passage edge 64 to the heat transfer section 43.

The base edge 61 extends from a first base end 611 to a second base end 612 of the fluid distribution plate 60, and the tip 62, is located between the two base ends 611, 612, as seen along a direction D1 that is perpendicular to a line L1' that extends from the first base end 611 to the second base end 612.

The line L1' that extends from the first base end 611 to the second base end 621 forms a first line L1' for the fluid distribution plate 60. A second line L2' extends from the first base end 611 to a point 621 on the distal part 62, or tip 62. A third line L3' extends from the second base end 612 to the point 621 on tip 62. By virtue of the location of the tip 62, the first, second and third lines L1', L2', L3' form an acute triangle. The fluid passage edge 64 comprises a concave shape. The closed edge 63 also comprises a concave shape. The lines L1', L2', L3' are all straight lines.

The fluid passage edge 64 comprises at least one edge section 641 that extends from a first point 642 on the fluid passage edge 64, to a second point 643 on the fluid passage edge 64, where the second point 643 is located closer to the base edge 61 than the first point 621. Using this terminology, another embodiment of the fluid distribution plate 60 comprises: the base edge 61 that faces the heat transfer section 43 of the base plate 40; a fluid passage edge 64 that has an edge section 641 that extends from a first point 642 on the fluid passage edge 64 to a second point 643 on the fluid passage edge 64, the first point 642 being located further away from the base edge 61 than the second point 643; a closed edge 63; and the fluid distribution channels 66 that extend from the fluid passage edge 64 to the base edge 61, for leading the fluid F2 from the fluid passage edge 64 to the heat transfer section 43.

A straight line, which for the illustrated embodiment is the same line as the second line L2' (but not necessarily so), extends through the first point 642 and through the second point 643 and is inclined to the first line L1' by an angle $\alpha 2$ of between 15 to 75 degrees. The different embodiments, or variants for describing the fluid distribution plate 60, may be combined.

As may be seen from the figures, the distal part 62 is a first distal part 62, or first tip 62, and the fluid passage edge 64 is a first fluid passage 64. The distribution plate 60 comprises a second distal part 67, or tip 67, that is located at a distance h4 from the base edge 61. A second fluid passage edge 65 has an extension in a direction D1 from the base edge 61, towards the second tip 67. The closed edge 63 extends from the first tip 62 to the second tip 67.

Thus, the fluid distribution plate 60 comprises: the base edge 61; a second tip 67 that is located at a distance h4 from the base edge 61, the closed edge 63 extending from the first tip 62 to the second tip 67; the second fluid passage 65 extending from the second tip 52, in the direction towards the base edge 51 and from a side of the second tip 62 that is opposite a side of the second tip 67 from which the closed edge 63 extends.

The second fluid passage 65 comprises a concave shape, and has the same shape and the same corresponding features as the first fluid passage 64, with the difference that it is mirrored. Basically, the fluid passage edges 64, 65 comprise the form of a respective arc that extends into the fluid distribution plate 60. The closed edge 63 also comprises the form of an arc that extends into the fluid distribution plate 60.

As mentioned, the fluid passage edge 64 comprises a first section 641. This section is located further away from the base edge 61 than a second, different section 644 of the fluid passage edge 64. Fluid distribution channels 662 at the second section 644 have a higher flow resistance in relation to the length of the fluid distribution channel than fluid distribution channels 661 at the first section 641. An alternative formulation of this is that fluid distribution channels 662 extending from the second section 644 have a higher flow resistance in relation to the length of the fluid distribution channel than fluid distribution channels 661 extending from the first section 641. Another alternative formulation of this is that fluid distribution channels 662 that extend from the fluid passage edge 64 at the second section 644 to the base edge 61 have a higher flow resistance in relation to the length of the fluid distribution channel than fluid distribution channels 661 that extend from the fluid passage edge 64 at the first section 641 to the base edge 61. By having a higher flow resistance in relation to the length of the fluid distribution channel in the fluid distribution channels 662 at the second section 644 than in the fluid distribution channels 661 at the first section 641, the fluid entering the heat transfer section 43 of the base plate 40 will have more uniform characteristics which implies that the fluid entering the heat transfer section will be more homogenous e.g. in terms of speed and pressure and the fluid will be more evenly distributed over the heat transfer section 43 of the base plate 40. Thereby, a more efficient heat transfer is obtained. By having a higher flow resistance in relation to the length of the fluid distribution channel for the fluid distribution channels 662 at the second section 644 than for fluid distribution channels 661 at the first section 641, it is compensated for the longer fluid distribution channels at the first section.

Fluid distribution channels 662 at the second section 644 may have a higher flow resistance per unit length of the fluid distribution channel than fluid distribution channels 661 at the first section 641.

Fluid distribution channels 661 at the first section 641 may have substantially the same flow resistance, e.g. substantially the same friction, as fluid distribution channels 662 at the second section 644. More precisely, fluid distribution channels 661 at the first section 641 may have substantially the same total flow resistance as fluid distribution channels 662 at the second section 644. That is, fluid distribution channels 661 at the first section 641 may have substantially the same flow resistance over the whole fluid distribution channel, i.e. the same total flow resistance from the fluid passage edge 64 to the base edge 61, as fluid distribution channels 662 at the second section 644. Thereby, the fluid from the fluid distribution channels 661 at the first section 641 and from the fluid distribution channels 662 at the second section 644 entering the heat transfer section 43 of the base plate 40 will have uniform characteristics e.g. in terms of speed and pressure and the fluid will be evenly distributed over the heat transfer section 43 of the base plate 40. This can also be expressed as that fluid distribution channels 661 at the first section 641 may have substantially the same pressure drop, i.e. the same total pressure drop, as fluid distribution channels 662 at the second section 644. The pressure drop is the difference in pressure between the inlet and outlet to the distribution channel, i.e. the difference between the pressure at the fluid passage edge 64 and the pressure at the base edge 61.

A higher flow resistance may be obtained by a smaller mean cross-sectional area of the fluid distribution channels and/or by restraints in the fluid distribution channels.

Fluid distribution channels 662 at the second section 644 have a smaller mean cross-sectional area than fluid distribution channels 661 at the first section 641. A mean cross-sectional area is an average cross-sectional area along the fluid distribution channel extending from the fluid passage edge 64 to the base edge 61. A smaller mean cross-sectional area gives a higher flow resistance and a higher pressure drop.

A smaller mean cross-sectional area may be obtained by fluid distribution channels 662 at the second section 644 being narrower than fluid distribution channels 661 at the first section 641, fluid distribution channels 661 at the first section 641 being divided into subchannels and/or divided into more subchannels than fluid distribution channels 662 at the second section 644 and/or fluid distribution channels 661 at the first section 641 being divided into subchannels being wider than subchannels into which fluid distribution channels 662 at the second section 644 are divided. Thus, both fluid distribution channels 661 at the first section 641 and fluid distribution channels 662 at the second section 644 may be divided into subchannels, but the subchannels of fluid distribution channels 661 at the first section 641 are more and/or wider than subchannels of fluid distribution channels 662 at the second section 644.

Fluid distribution channels 662 at the second section 644 being narrower than fluid distribution channels 661 at the first section 641 implies that fluid distribution channels 661 at the first section 641 are wider than fluid distribution channels 662 at the second section 644.

Fluid distribution channels 662 at the second section 644 may comprise a restraint, e.g. fluid distribution channels 662 at the second section 644 may comprise a winding or an obstacle. A restraint gives a higher flow resistance and a higher pressure drop.

The winding may for example be a meander, such as a zig-zag path, such that the fluid distribution channels 662 at the second section 644 comprises at least a portion that describes a winding, such as a meander. The fluid distribution channels 662 at the second section 644 may be in the shape of a meander.

The obstacle may be an object, such as a knob or a pillar, arranged in the fluid distribution channel or a protuberance in the plate projecting into the fluid distribution channel.

Fluid distribution channels 662 extending from a position on the fluid passage edge 64 relatively further away from the distal part 62 in the direction D1 have a gradually higher flow resistance in relation to the length of the fluid distribution channel than fluid distribution channels 661 extending from a position on the fluid passage edge 64 relatively closer to the distal part 62 in the direction D1. The gradually higher flow resistance in relation to the length of the fluid distribution channel may be continuously higher for each fluid distribution channel or stepwise higher. Stepwise higher flow resistance may be arranged such that a group of adjacent fluid distribution channels have the same flow resistance in relation to the length of the fluid distribution channel. The stepwise higher flow resistance may be obtained such that a first group of fluid distribution channels, preferably comprising a small number of fluid distribution channels, relatively closer to the distal part basically have the same flow resistance in relation to the length of the fluid distribution channel and a second group of fluid distribution channels, preferably also comprising a small number of fluid distribution channels which number may be the same or different as the number of fluid distribution channels in the first group of fluid distribution channels, relatively further away from the distal part basically have the same flow resistance in relation to the length of the fluid distribution channel and the second group of fluid distribution channels have a higher flow resistance in relation to the length of the fluid distribution channel than the first group of fluid distribution channels, Fluid distribution channels 661 at the first section 641 are wider than fluid distribution channels 662 at the second section 644. In principle, fluid distribution channels extend from the fluid passage edge 64 to the base line 61. Those channels that extend further away from the base line 61, i.e. those that are relatively longer, are wider than those channels that have a shorter extension.

The fluid passage edge 53 has a concave shape in the first type of fluid distribution plate 50. The closed edge 63 has a concave shape in the second type of fluid distribution plate 60.

Thus the plate heat exchanger 1 has a number of heat transfer plates 31-33 that are joined to each other to form a plate stack 20 that has alternating first and second flow paths 21, 22 for the first fluid F1 and the second fluid F2. Due to the different types of heat transfer plates, all fluid passage edges 53 of flow distribution plates 50 in the first fluid path 21 and at a first end of the plate stack 20 form a fluid inlet for the first fluid F1 into the plate stack 20. Fluid passage edges 53 of flow collection plates 50' in the first fluid path 21 and at a second end of the plate stack 20 form a fluid outlet for the first fluid F1 from the plate stack 20. When the fluids F1, F2 flow in opposite directions in the plate stack 20, fluid passage edges 64, 65 of flow collection plates 60' in the second fluid path 22 and at the first end of the plate stack 20 form a fluid outlet for the second fluid F2 from the plate stack 20. Fluid passage edges 64, 65 of flow distribution plates 60 in the second fluid path 22 and at the second end of the plate stack 20 then form a fluid inlet for the second fluid F2 into the plate stack 20.

Thus, the fluid distribution plates 50 of every second heat transfer plate 31 comprises respective two tips 52, 57 that are located at a respective distance h1, h2 from the base edge 51 the fluid distribution plate 50, has a fluid passage edge 53 that has an extension between the two tips 52, 57, and has two closed edges 54, 55 that are located at a respective side of the fluid passage edge 53. The fluid distribution plates 60 of every other, second heat transfer plate 32 comprises respective two tips 62, 67 that are located at a respective distance d3, d4 from the base edge 61 of the fluid distribution plate 60, has a closed edge 63 that has an extension between the two tips 62, 67, and has two fluid passage edges 64, 65 that are located at a respective side of the closed edge 63. Typically, the distances h1 and h2 are equal, while the distances h3 and h4 are equal.

The first header box 7 covers all fluid passage edges 53, 64, 65 of flow distribution plates 50 and flow collection plates 60' that are located at the first end of the plate stack 20 (see FIG. 3). The second header box 8 covers all fluid passage edges 53, 64, 65 of flow distribution plates 60 and flow collection plates 50' that are located at the second end of the plate stack 20. The first header box 7 has a pipe 9 for receiving the first fluid F1, and the pipe 9 has an outlet opening 901 that faces the fluid passage edges 53 of flow distribution plates 50 that are located at the first end of the plate stack 20. The pipe 9 receives the first fluid F1 from the inlet 2 and leads it to the fluid passage edges 53. The header box 7 has also a hollow space 701 in which the pipe 9 is arranged. The hollow space 701 is sealed from the interior of the pipe 9 and faces the fluid passage edges 64, 65 of fluid collection plates 60' that are located at the first end of the plate stack 20. The hollow space 701 receives the second fluid F2 from the fluid passage edges 64, 65 of the collection plates 60' for the second type of heat transfer plates, like second heat transfer plate 32, and leads the second fluid F2 to its outlet 5 in the first header box 7.

The second header box 8 is identical to the first header box 7 and is arranged at the second end of the plate stack 20. The second header box 8 has thus a pipe 10 with an opening for receiving the first fluid F1 when it exits the plate stack 20. Obviously, the pipe opening in the pipe faces the fluid passage edges 53 of flow collection plates 50' that are located at the second end of the plate stack 20. The pipe 10 transports the first fluid F1 to the outlet 3. The hollow space of the second header box 8 comprises the inlet 4 for the second fluid F2 and leads the second fluid F2 to the fluid passage edges 64, 65 of the distribution plates 60 for the second type of heat transfer plates 32.

Figure 19:
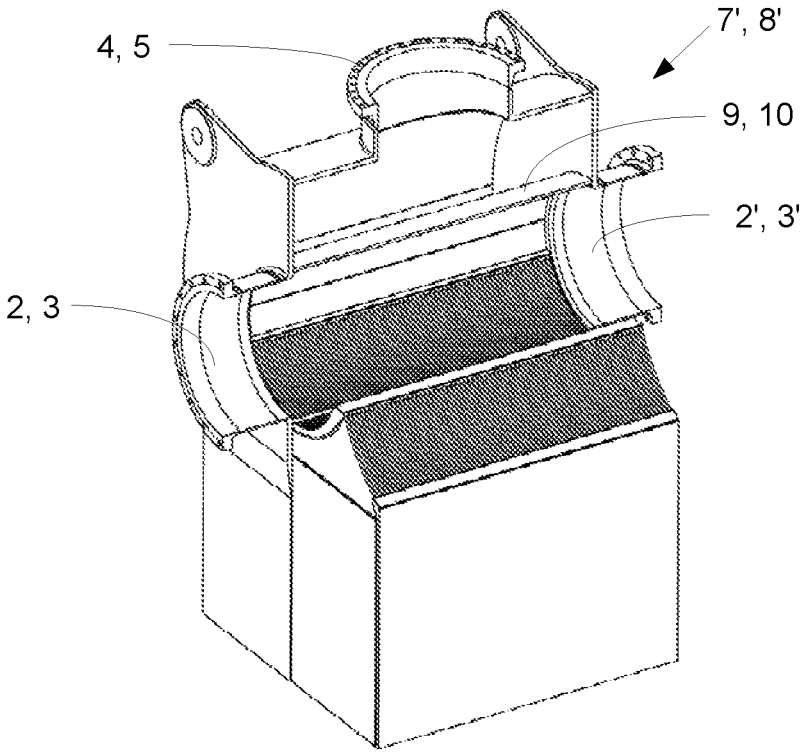

As an alternative to the header boxes 7, 8 shown in FIGS. 1-3, header boxes 7', 8' as shown in FIG. 19 can be used. The header box 7' is similar to the header box 7, but in addition to the inlet 2, the header box 7' has an inlet 2' arranged opposite the inlet 2, i.e. in a wall of the header box opposite the wall in which the inlet 2 is arranged. The pipe 9 receives the first fluid F1 from the inlets 2, 2' and leads it to the fluid passage edges 53. The header box 8' is identical to the header box 7' and thereby also similar to the header box 8. In addition to the outlet 3, the header box 8' has an outlet 3'. The pipe 10 transports the first fluid F1 to the outlets 3, 3'.

Figure 20:
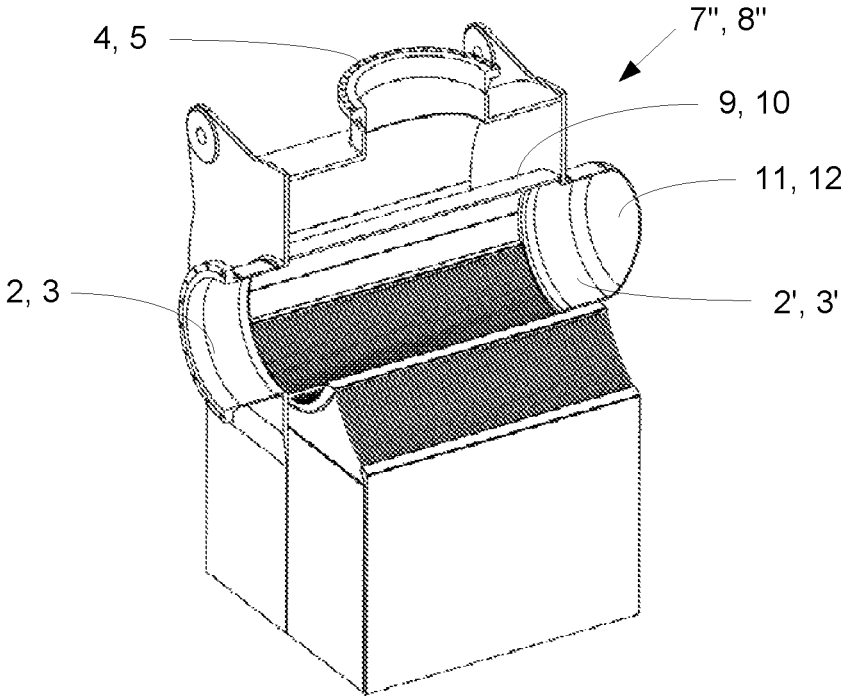

As another alternative to the header boxes 7, 8 shown in FIGS. 1-3, header boxes 7", 8" as shown in FIG. 20 can be used. The header box 7" is similar to the header box 7', and also has an inlet 2' in addition to the inlet 2, which inlet 2' is arranged opposite the inlet 2. However, the inlet 2' is closed by a cap 11 such that the pipe 9 receives the first fluid F1 from only the inlet 2 and leads it to the fluid passage edges 53. The header box 8" is identical to the header box 7" and thereby also similar to the header box 8'. The header box 8" also has an outlet 3' in addition to the outlet 3. However, the outlet 3' is closed by a cap 12 such that the pipe 10 transports the first fluid F1 to only the outlets 3.

Figure 21:
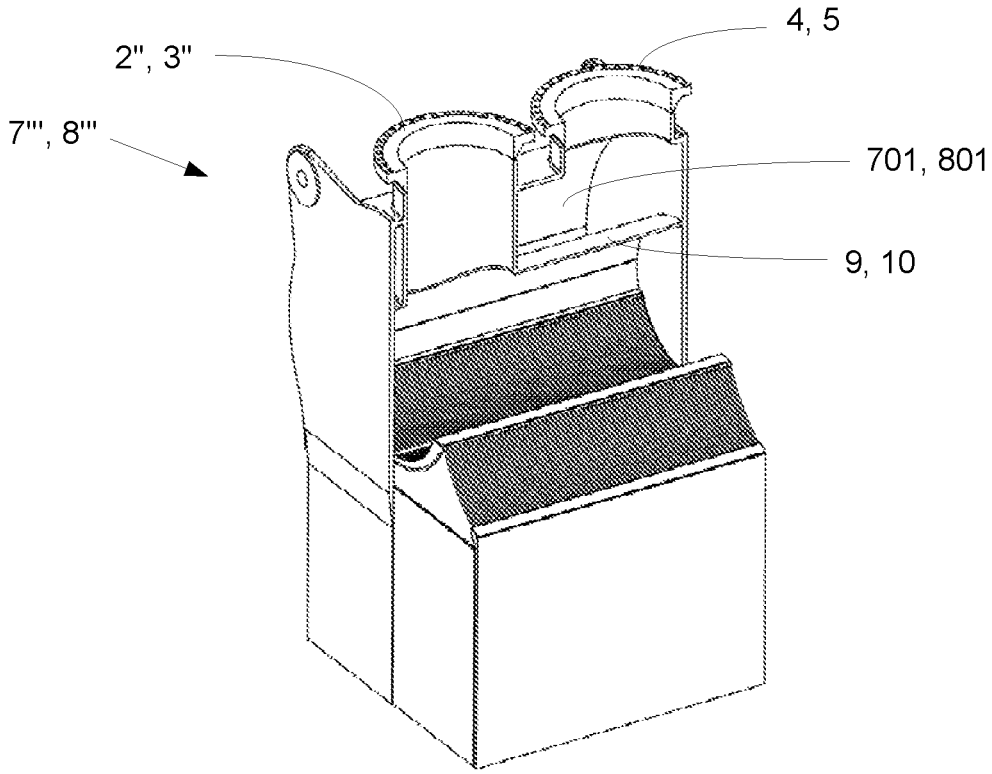

As a further alternative to the header boxes 7, 8 shown in FIGS. 1-3, header boxes 7'", 8'" as shown in FIG. 21 can be used. The header box 7'" is similar to the header box 7, but instead of the inlet 2 the header box 7'" comprises an inlet pipe 2" perpendicularly connected to the pipe 9 and extending through the hollow space 701 of the header box. The header box 8'" is identical to the header box 7'" and thereby also similar to the header box 8. Instead of the outlet 3 the header box 8'" comprises an outlet pipe 3" perpendicularly connected to the pipe 10 and extending through the hollow space 801.

Each of the two different types of distribution plates 50, 60 may be made in a respective, one piece. However, they may be made of two respective pieces, as illustrated in the figures, which typically are mirror images of each other.

Figure 15:
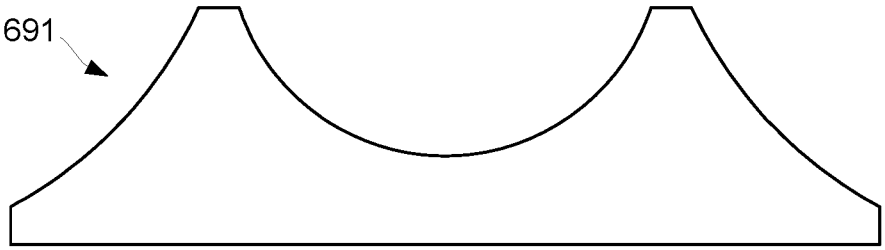
FIGS. 15-18 are alternative, principal shapes that may be used for plates shown in FIGS. 13 and 14, FIGS. 19-21 are perspective views of alternative header boxes for the plate heat exchanger shown in FIG. 1.
Figure 16:
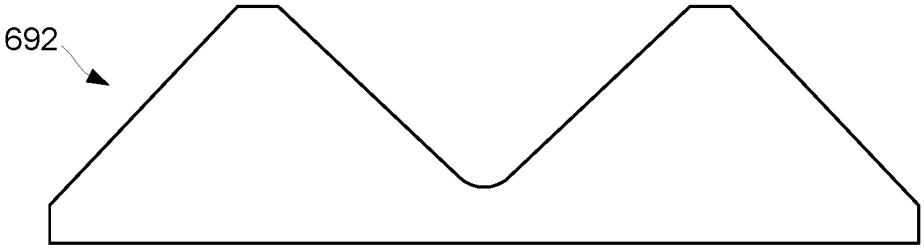
Figure 17:
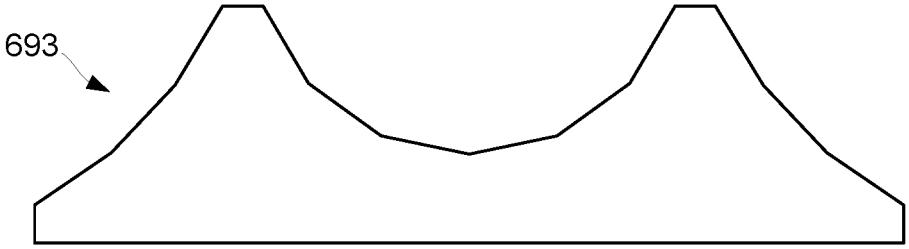
Figure 18:
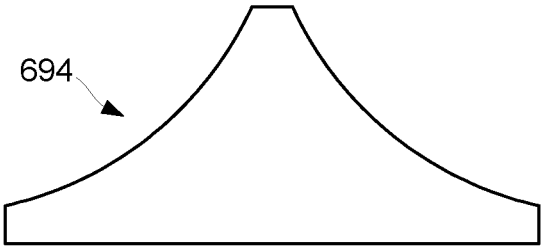

With further reference to FIGS. 15-18, the fluid distribution plates 50, 60, and thus also the fluid collection plates 50', 60', since these may be identical to the fluid distribution plates 50, 60, may have other principal shapes than those shown in connection with FIGS. 13 and 14. FIG. 15 shows the same principal shape 691 as FIGS. 13 and 14. However, the plates may have a more straight shape 692 for the fluid passage edges and the closed edges, as shown in FIG. 16, or they may a shape 693 where the fluid passage edges and the closed edges have the form of straight lines that in combination form the principal shape of an arc, as shown in FIG. 17. In one special embodiment, as shown in FIG. 18, the shape 694 provides only one inlet edge and one closed edge, which located on a respective side of one single tip. In this case the header boxes should be modified for achieving a proper fluid distribution and fluid collection.

From the description above follows that, although various embodiments of the invention have been described and shown, the invention is not restricted thereto, but may also be embodied in other ways within the scope of the subject-matter defined in the following claims.

The invention claimed is:

1. A heat transfer plate possessing an outermost periphery, the heat transfer plate comprising a rectangular base plate with two longer sides, two shorter sides and four concave corner cutouts, each of the concave corner cutouts being positioned between one of the longer sides and one of the shorter sides of the base plate, the base plate having a first end section at one of the shorter sides, a second end section at the other shorter side, and a heat transfer section that is located between the first and second end sections, the heat transfer section of the base plate being corrugated, the first end section of the base plate not being corrugated so that the first end section of the base plate is flat, the second end section of the base plate not being corrugated so that the second end section of the base plate is flat, a fluid distribution plate that distributes a fluid over the heat transfer section, the fluid distribution plate being separate from the base plate and being arranged on the flat first end section of the base plate at the one shorter side of the base plate so that the fluid distribution plate and the flat first end section of the base plate overlie one another, a fluid collection plate that collects the fluid from the heat transfer section, the fluid collection plate being arranged on the flat second end section of the base plate at the other shorter side of the base plate so that the fluid collection plate and the flat second end section of the base plate overlie one another, the fluid distribution plate comprising:

a base edge that faces the heat transfer section of the base plate, a distal part that is located at a distance from the base edge, a fluid passage edge that permits fluid flow and that extends in a direction from the base edge towards the distal part, the fluid passage edge being a part of the outermost periphery of the heat transfer plate, a closed edge that is closed to fluid flow and that extends from the base edge towards the distal part, and fluid distribution channels that extend from the fluid passage edge to the base edge, for leading the fluid from the fluid passage edge to the heat transfer section, the fluid distribution plate being corrugated so that corrugations of the fluid distribution plate define the fluid distribution channels, wherein the fluid passage edge comprises a first section that is further away from the base edge of the fluid distribution plate than a second section of the fluid passage edge, the fluid distribution channels including fluid distribution channels intersecting the first section of the fluid passage edge and fluid distribution channels intersecting the second section of the fluid passage edge, and the fluid distribution channels intersecting the second section have a higher flow resistance in relation to the length of the fluid distribution channel than fluid distribution channels intersecting the first section.

2. A heat transfer plate according to claim 1, wherein fluid distribution channels at the second section have a smaller mean cross-sectional area than fluid distribution channels at the first section and/or fluid distribution channels at the second section comprise a restraint.

3. A heat transfer plate according to claim 1, wherein the base edge of the fluid distribution plate extends from a first base end to a second base end of the fluid distribution plate, the distal part being located, as seen along a direction that is perpendicular to a line that extends from the first base end to the second base end, between the two base ends.

4. A heat transfer plate according to claim 3, wherein the distal part is a first distal tip that is a part of the fluid distribution plate positioned furthest from the base edge of the fluid distribution plate as measured in a direction perpendicular to the base edge of the fluid distribution plate, the line that extends from the first base end to the second base end is a first line, a second line extends from the first base end to the first distal tip, and a third line extends from the second base end to the first distal tip, the first, second and third lines forming an acute triangle.

5. A heat transfer plate according to claim 1, wherein the fluid passage edge of the fluid distribution plate comprises at least one edge section that extends from a first point on the fluid passage edge to a second point on the fluid passage edge, the second point being located closer to the base edge of the fluid distribution plate than the first point.

6. A heat transfer plate according to claim 1, wherein the distal part is a first distal tip and the closed edge is a first closed edge, the first closed edge and the fluid passage edge intersecting at the first distal tip, the fluid distribution plate comprising a second distal tip that is located at a distance from the base edge, a second closed edge that extends from the base edge to the second distal tip, the second closed edge and the fluid passage edge intersecting at the second distal tip and the fluid passage edge extending from the first distal tip to the second distal tip, the first and second distal tips being parts of the fluid distribution plate positioned furthest from the base edge as measured in a direction perpendicular to the base edge.

7. A heat transfer plate according to claim 1, wherein fluid distribution channels at the first section are wider than fluid distribution channels at the second section.

8. A heat exchanger comprising a number of heat transfer plates according to claim 1, that are joined to each other to form a plate stack that has alternating first and second flow paths for a first fluid and a second fluid in between the heat transfer plates, wherein fluid passage edges of fluid distribution plates in the first fluid path and at a first end of the plate stack form a fluid inlet for the first fluid into the plate stack, fluid passage edges of fluid collection plates in the first fluid path and at a second end of the plate stack form a fluid outlet for the first fluid from the plate stack, fluid passage edges of fluid collection plates in the second fluid path and at the first end of the plate stack form a fluid outlet for the second fluid from the plate stack, and fluid passage edges of fluid distribution plates in the second fluid path and at the second end of the plate stack form a fluid inlet for the second fluid into the plate stack.

9. A heat exchanger according to claim 8, wherein the fluid distribution plates of every second heat transfer plate comprises respective two distal parts that are located at a respective distance from a base edge of the fluid distribution plate, a fluid passage edge that has an extension between the two distal parts, and two closed edges that are located at a respective side of the fluid passage edge, the fluid distribution plates of every other, second heat transfer plate comprises respective two distal parts that are located at a respective distance from a base edge of the fluid distribution plate, a closed edge that has an extension between the two distal parts, and two fluid passage edges that are located at a respective side of the closed edge.

10. A heat exchanger according to claim 8, comprising spacers that are located between adjacent heat transfer plates, along the longer sides of the base plate and along portions of the base plate where closed edges of the fluid distribution plates are located.

11. A heat exchanger according to claim 10, wherein the spacers are separate from the base plate and the fluid distribution plates, and wherein the spacers comprise tabs that engage the fluid distribution plates.

12. A heat exchanger according to claim 8, comprising a header box that covers fluid passage edges of fluid distribution plates and fluid collection plates that are located at the first end of the plate stack.

13. A heat exchanger according to claim 12, wherein the header box comprises a pipe for receiving the first fluid, the pipe having an outlet opening that faces the fluid passage edges of fluid distribution plates that are located at the first end of the plate stack.

14. A heat exchanger according to claim 13, wherein the header box comprises a hollow space in which the pipe is arranged, the hollow space being sealed from the interior of the pipe and facing the fluid passage edges of fluid collection plates that are located at the first end of the plate stack.

15. A heat transfer plate possessing an outermost periphery, the heat transfer plate comprising:

a rectangular base plate with two longer sides, two shorter sides and four concave corner cutouts, each of the concave corner cutouts being positioned between one of the longer sides and one of the shorter sides of the base plate, the base plate including a first end section at one of the shorter sides, a second end section at the other shorter side, and a heat transfer section located between the first and second end sections, the heat transfer section of the base plate being corrugated, the first end section of the base plate not being corrugated so that the first end section of the base plate is flat, the second end section of the base plate not being corrugated so that the second end section of the base plate is flat;

a fluid distribution plate that distributes a fluid over the heat transfer section, the fluid distribution plate being separate from the base plate and being arranged on the flat first end section of the base plate so that the fluid distribution plate and the flat first end section of the base plate overlie one another; and a fluid collection plate that collects the fluid from the heat transfer section, the fluid collection plate being arranged on the flat second end section of the base plate so that the fluid collection plate and the flat second end section of the base plate overlie one another;

the fluid distribution plate comprising:

a base edge facing the heat transfer section of the base plate, a first distal part located at a distance from the base edge, a second distal part located at the distance from the base edge, the second distal part being spaced apart from the first distal part, a fluid passage edge possessing a concave shape and extending between the first distal part and the second distal part such that the fluid passage edge possessing the concave shape is closer to the base edge than the first and second distal parts, the fluid passage edge permitting fluid flow and being a part of the outermost periphery of the heat transfer plate, a closed edge that is closed to fluid flow and that extends from the base edge towards the first distal part, fluid distribution channels that extend from the fluid passage edge to the base edge for leading the fluid from the fluid passage edge to the heat transfer section, the fluid distribution plate being corrugated so that corrugations of the fluid distribution plate define the fluid distribution channels, and the fluid passage edge comprising a first section that is further away from the base edge of the fluid distribution plate than a second section of the fluid passage edge, the fluid distribution channels including fluid distribution channels intersecting the first section of the fluid passage edge and fluid distribution channels intersecting the second section of the fluid passage edge, the fluid distribution channels intersecting the second section having a higher flow resistance in relation to the length of the fluid distribution channel than the fluid distribution channels intersecting the first section.

16. A heat transfer plate possessing an outermost periphery, the heat transfer plate comprising:

a rectangular base plate with two longer sides, two shorter sides and four concave corner cutouts, each of the concave corner cutouts being positioned between one of the longer sides and one of the shorter sides of the base plate, the base plate including a first end section at one of the shorter sides, a second end section at the other shorter side, and a heat transfer section located between the first and second end sections, the heat transfer section of the base plate being corrugated, the first end section of the base plate not being corrugated so that the first end section of the base plate is flat, the second end section of the base plate not being corrugated so that the second end section of the base plate is flat;

a fluid distribution plate that distributes a fluid over the heat transfer section, the fluid distribution plate being separate from the base plate and being arranged on the flat first end section of the base plate so that the fluid distribution plate and the flat first end section of the base plate overlie one another; and a fluid collection plate that collects the fluid from the heat transfer section, the fluid collection plate being arranged on the flat second end section of the base plate so that the fluid collection plate and the flat second end section of the base plate overlie one another, the fluid collection plate being identical to the fluid distribution plate;

the fluid distribution plate comprising:

a base edge facing the heat transfer section of the base plate, the base edge possessing a midpoint, a distal part located at a distance from the base edge, a concave fluid passage edge that permits fluid flow and that extends in a direction from the distal part towards the base edge, the concave fluid passage edge being a part of the outermost periphery of the heat transfer plate, a concave closed edge that is closed to fluid flow and that extends from the base edge to the distal part, fluid distribution channels that extend from the fluid passage edge to the base edge for leading the fluid from the fluid passage edge to the heat transfer section, the fluid distribution channels being symmetrical about a plane passing through the midpoint of the base edge and perpendicular to the base edge, the fluid distribution plate being corrugated so that corrugations of the fluid distribution plate define the fluid distribution channels, the fluid passage edge comprising a first section that is further away from the base edge of the fluid distribution plate than a second section of the fluid passage edge, the fluid distribution channels including fluid distribution channels intersecting the first section of the fluid passage edge and fluid distribution channels intersecting the second section of the fluid passage edge, the fluid distribution channels intersecting the second section have a higher flow resistance in relation to the length of the fluid distribution channel than fluid distribution channels intersecting the first section; and a plurality of the fluid distribution channels intersecting the first section of the fluid distribution plate being non-linear fluid distribution channels, a plurality of the fluid distribution channels intersecting the first section of the fluid collection plate being non-linear fluid distribution channels, a plurality of the fluid distribution channels intersecting the second section of the fluid distribution plate being non-linear fluid distribution channels, a plurality of the fluid distribution channels intersecting the second section of the fluid collection plate being non-linear fluid distribution channels.

17. The heat transfer plate according to claim 1, wherein all of the fluid distribution channels intersecting the first section of the fluid distribution plate are non-linear fluid distribution channels.

18. The heat transfer plate according to claim 15, wherein a plurality of the fluid distribution channels intersecting the first section of the fluid collection plate are non-linear fluid distribution channels, and a plurality of the fluid distribution channels intersecting the second section of the fluid distribution plate are non-linear fluid distribution channels.

19. A heat transfer plate according to claim 15, wherein the base edge of the fluid distribution plate extends from a first base end of the fluid distribution plate to a second base end of the fluid distribution plate, the first distal part being a first distal tip that is a part of the fluid distribution plate positioned furthest from the base edge of the fluid distribution plate as measured in a direction perpendicular to the base edge of the fluid distribution plate, a line extending from the first base end to the second base end is a first line, a line extending from the first base end to the first distal tip is a second line, and a line extending from the second base end to the first distal tip is a third line, the first, second and third lines forming an acute triangle.

20. A heat transfer plate according to claim 16, wherein the base edge of the fluid distribution plate extends from a first base end of the fluid distribution plate to a second base end of the fluid distribution plate, the distal part being a first distal tip that is a part of the fluid distribution plate positioned furthest from the base edge of the fluid distribution plate as measured in a direction perpendicular to the base edge of the fluid distribution plate, a line extending from the first base end to the second base end is a first line, a line extending from the first base end to the first distal tip is a second line, and a line extending from the second base end to the first distal tip is a third line, the first, second and third lines forming an acute triangle.

21. A heat transfer plate according to claim 16, wherein the concave fluid passage edge is defined by a plurality of straight lines that in combination form an arc.

22. A heat transfer plate according to claim 16, wherein the concave fluid passage edge is continuously curved.

* * * * *